United States Patent [19]

Bein

[11] Patent Number: 4,880,367

[45] Date of Patent: Nov. 14, 1989

[54] RIGID SUPPORT STRUCTURE FOR SINGLE SCREW COMPRESSORS

[76] Inventor: Thomas W. Bein, 1283 Swan Dr., Annapolis, Md. 21401

[21] Appl. No.: 204,323

[22] Filed: Jun. 9, 1988

Related U.S. Application Data

[63] Continuation-in-part of Ser. No. 834,991, Feb. 28, 1986, abandoned.

[51] Int. Cl.[4] ..... F04C 18/20

[52] U.S. Cl. ..... 418/107; 418/195

[58] Field of Search ..... 418/107, 195, 196

[56] References Cited

U.S. PATENT DOCUMENTS

| | | | |
|---|---|---|---|
| 1,946,097 | 2/1934 | Morris et al. | 418/195 |
| 2,232,702 | 2/1941 | Holzknecht | 418/107 |
| 3,133,695 | 5/1964 | Zimmern | 418/195 |
| 3,181,296 | 5/1965 | Zimmern | 60/39.63 |
| 3,551,082 | 12/1970 | Zimmern | 418/195 |
| 3,752,606 | 8/1973 | Zimmern | 418/97 |
| 3,788,784 | 1/1974 | Zimmern | 418/195 |
| 4,227,867 | 10/1980 | Whitehill et al. | 418/97 |

FOREIGN PATENT DOCUMENTS

| | | | |
|---|---|---|---|
| 1496275 | 8/1967 | France | 418/195 |

*Primary Examiner*—John J. Vrablik

*Attorney, Agent, or Firm*—Luther A. Marsh; William C. Townsend; John H. Stowe

[57] ABSTRACT

A single screw compressor for varying the pressure of a fluid characterized in that the alignment of the mainrotor and the gaterotor axes is maintained in the presence of distortion due to temperature and pressure gradients. The structural arrangement permits fabrication of a relatively light weight compressor.

32 Claims, 3 Drawing Sheets

RIGID SUPPORT STRUCTURE FOR SINGLE SCREW COMPRESSORS

CROSS REFERENCE TO RELATED APPLICATIONS

This application is a continuation in part of application Ser. No. 06/834,991 filed Feb. 28, 1986, now abandoned.

BACKGROUND OF THE INVENTION

In order to form single screw compressors, or positive displacement type machines for varying the pressure to a gas, it is known to make use of combinations comprising a mainrotor, having a toroidal surface and projecting threads having a generally helicoidal shape. The crests of said threads are intended to cooperate with a casing, thereby forming compression chambers and the mainrotor is adapted to cooperate with one or a number of gaterotors, the teeth of which are in meshing relation with the threads formed on the mainrotor. Examples of single screw compressors are shown in U.S. Pat. Nos. to Zimmern 3,551,082, 3,133,695, 3,181,296 and 3,752,606.

The space formed between two adjacent threads of a mainrotor of this type cooperating with an internal surface of the casing can accordingly form a compression chamber which is sealed off at one end by a tooth of one of the gaterotors and sealed off at the other end by providing the casing with a closed end.

When a fluid such as air or gas enters into a compression chamber of this type, the rotation of the mainrotor permits a progressive reduction in volume of the compression chamber, compressing the fluid until said compression chamber is put into communication with an outlet which can be formed in the casing.

Because there is relative motion between the parts in the single screw compressor, the clearance between the parts can only be reduced to a minimum finite value. Even when clearances have been reduced to operational minimums, there are still a large number of paths where the fluid being compressed can leak out.

Current practice in the design and manufacture of single screw compressors is to rotationally support the mainrotor and gaterotors in a structure that is also a pressure vessel for containing the inlet pressure when the inlet pressure is above atmospheric pressure. To a large extent, the structure necessary for maintaining the axes in alignment and the structure necessary for containing the pressure of a pressurized inlet are interactive and must be compromised. In these machines, the casing not only provides the structural support for the mechanism but it also provides the containment of the inlet pressure. When the mechanism is operating at inlet pressures above atmospheric as is done when the mechanism is being used as a second or subsequent stage compressor, frequently in the range of 100 to 200 bar (1500 to 3000 psi), distortion of the pressure vessel results due to elastic deformation. This distortion will move the mainrotor and gaterotor rotational axes away from their desired alignment. Because of this shift in the rotational axes due to the elastic deformation of the supporting structure of a conventional machine, design clearances between the meshing rotors must be compromised and an unacceptable amount of the fluid being compressed is allowed to leak out. Furthermore, as the compressor is operating, the compression zones are heated more than the rest of the casing. The combination of this localized heating and the thickness variations in the casing results in non-uniform thermal expansion causing tight clearances between the rotating elements. In a conventional machine, the structural shifting due to pressure must be accepted or the structure made heavier. When the structure is made heavier, a weight penalty results. That is, as the inlet pressure increases, the mechanism requires heavier structural components, making the mechanism progressively more difficult to build, install and maintain, or if the structural strength is not increased, the leakage due to the shifting of the rotational axes under the stress of inlet pressure results in a decrease in the efficiency of the compressor. Unfortunately, as the structural components are made heavier to avoid the structural shifting due to increased inlet pressure, the reduction of clearances in a conventional machine due to the localized thermal expansion are aggravated.

Consequently, there is a need for a single screw mechanism that avoid the rotational axes shifts that result from a pressurized inlet or from internal thermal expansion.

SUMMARY OF THE INVENTION

The present invention relates to single screw compressors and more particularly to a support structure which allows for pressurizing the inlet of the compressor without shifting the axes alignment between the mainrotor and the gaterotors and which permits the meshing relationship between the mainrotor and the gaterotors to be less sensitive to localized thermal expansion. Making selected portions of the support structure relatively rigid but free to thermally expand allows the compressor to be placed in a generally lightweight pressure vessel which is easily removed, permitting inspection, alignment, and maintenance to be performed with respect to the casing, mainrotor and gaterotors without disturbing the alignment of the axes of rotation of the mainrotor and the gaterotors.

Accordingly, the present invention provides a rigid support system to rotationally support the mainrotor and gaterotors which is not affected by a pressurized inlet and which allows for thermal expansion without shifting of the rotational axes. By disconnection of the support for the gaterotors from the external housing which encloses the mainrotor, the mainrotor casing and the gaterotors, the shifting of the axes which occurs due to increased inlet pressures and thermal expansion in the compression chamber as occurs in conventional machines is avoided. The structure of the machine of the present invention allows the casing which encloses the mainrotor to be of substantially constant cross section permitting uniform thermal expansion of the mainrotor and the mainrotor casing.

Accordingly, the present invention, a single screw compressor for varying the pressure of a gas, comprises: a mainrotor formed with a plurality of threads having an axially extending integral mainrotor shaft; a casing, open at one end and having a large diameter bore for accommodation of the mainrotor coaxial with a small diameter bore for accommodation of the integral mainrotor shaft, the casing having a fluid outlet means and a fluid inlet means; a support plate having a central bore with bearing means for rotationally supporting the mainrotor shaft, the support plate affixedly attached to the mainrotor casing coaxially aligning the small diameter bore and said large diameter bore of the casing and the central bore of the support plate with the support plate having fluid outlet means in fluid communication with the fluid outlets means of the mainrotor casing; at least one gaterotor having teeth in meshing relation with said mainrotor threads; at least one gaterotor shaft having an inward end attached to the mainrotor casing, an intermediate length adapted for rotationally supporting the gaterotor, and an outward end; and, at least one elongate support arm affixedly attached at an inward end to the mainrotor casing and provided at an outward end with a bearing means for supporting the outward end of said gaterotor shaft. Alternatively, the elongate support arm may be attached to the support plate instead of the mainrotor casing.

An object of the present invention is to provide a rigid support structure for the rotational support of the mainrotor and gaterotors of a single screw compressor that will maintain rotational axis alignment especially in the presence of elevated inlet pressure such as occurs when the compressor acts as a second or subsequent stage machine.

It is still a further object of the invention to provide a combination of a rigid support structure and a lightweight pressure vessel that allows for a relatively lightweight compressor.

It is yet another object to the invention to provide a combination of a rigid support structure and a lightweight pressure vessel that allows easy access to the rotors, for assembly, inspection, alignment, adjustment, maintenance, and repair.

A more complete appreciation of the invention and many of the attendant features thereof will be readily appreciated as the same becomes better understood by reference to the following detailed description and when considered in connection with the accompanying drawing, wherein:

DETAILED DESCRIPTION OF THE INVENTION

Figure 1:
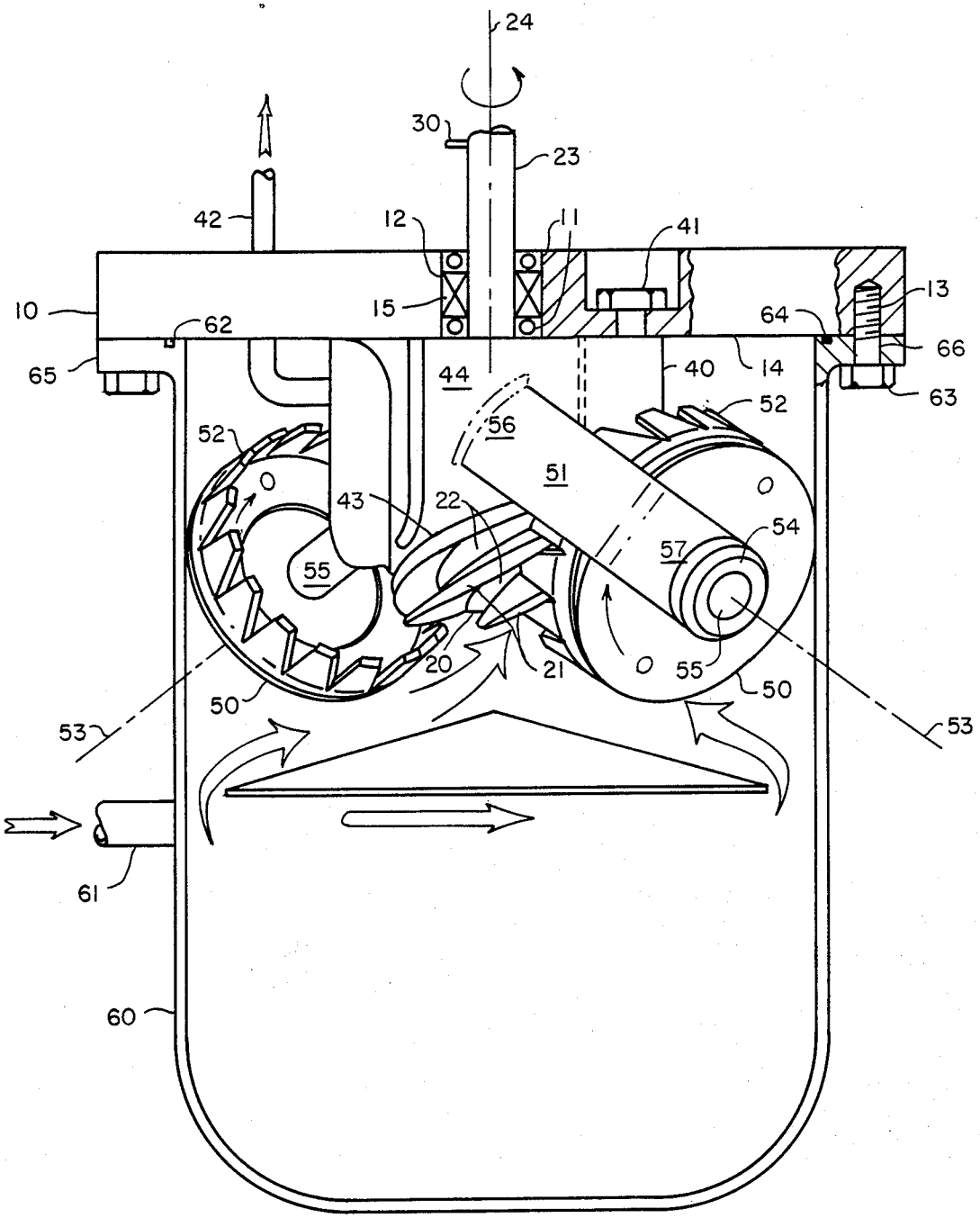
FIG. 1 illustrates a plan view of a single screw compressor partially cut away to show the rigid support structure for the rotational support of the mainrotor and gaterotors.
Figure 2:
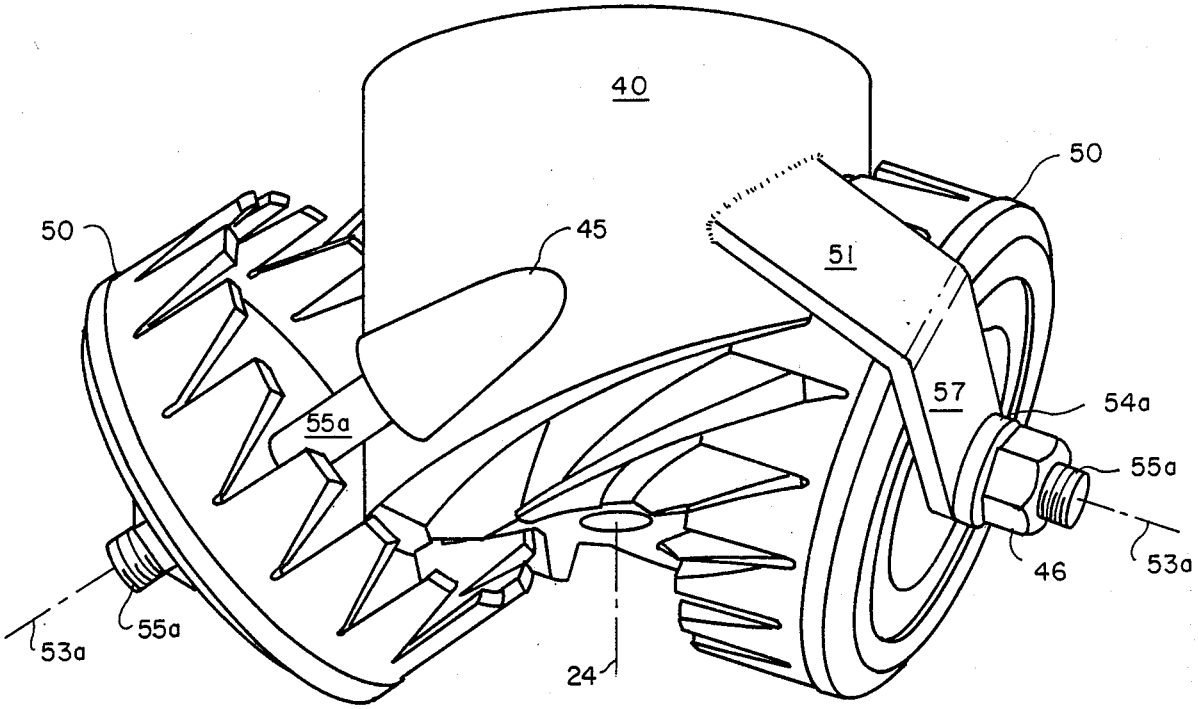
FIG. 2 is a perspective view of a portion of the compressor illustrated in FIG. 1.

Referring now to the drawings wherein like reference characters designate identical or corresponding parts throughout the several views:

In FIG. 1 and FIG. 2, a first embodiment of a single screw compressor rigid support structure for the mainrotor and gaterotors of the present invention is illustrated. The geometry of engagement of the mainrotor and the gaterotor is conventional, the improvement being in the arrangement of the supporting structure for rotational support of the mainrotor and gaterotors which permits enclosure of the inlet end of the compressor in a lightweight pressure vessel.

Support plate 10 is generally circular in shape and centrally bored to accommodate bearing means such as for example, ball bearings 11. Spacer 12 maintains the ball bearings 11 in a separated position. Support plate 10 is further provided with equispaced threaded bores 13 near the periphery of its bottom surface 14.

Mainrotor 20 with threads 21 and compression chambers 22 is rotatably supported via integral mainrotor shaft 23 in support plate 10 by bearings 11. The mainrotor shaft 23 has a rotational axis 24. Because mainrotor shaft 23 is now rotationally supported in a symmetrical support, thermal expansion will occur evenly and without causing undesirable tight clearances between the mainrotor shaft 23 and support plate bearings 11. Mainrotor shaft 23 projects beyond the support plate 10 for attachment to rotary power means 30 which can be an electric or other convenient prime mover.

Mainrotor casing 40 is generally of cylindrical shape, having a large diameter bore at an open end 43 for accommodation of the mainrotor 20 and a small diameter bore in a closed end 44, coaxially aligned with the large diameter bore for accommodation of mainrotor shaft 23. Mainrotor casing 40 is affixedly attached at said closed end to the bottom surface 14 of support plate 10, by fastening means such as cap screws 41. Mainrotor casing 40 and support plate 10 form a central structure within the compressor. The large diameter and small diameter casing bores are coaxially disposed about central bore 15 in support plate 10. Compression chambers 22 within mainrotor casing 40 are in fluid communication toward closed end 44 with fluid outlet means 42. Such communication can be by way of a conventional through bore, not shown, transverse to the large diameter bore of the mainrotor casing 40. A plurality of gaterotor support arms 51 are each affixedly attached at an inward end 56 to the exterior surface of mainrotor casing 40 and are each provided at an outward end 57 with a bore for receiving a bearing means 54 such as, for example, ball bearings.

Gaterotors 50 have teeth 52 arranged to mesh with the mainrotor compression chambers 22 in a conventional manner. Gaterotors 50 are adapted for rotation about gaterotor shafts 55 by bearing means (not shown) such as ball bearings. Gaterotor shafts 55 are supported at an outboard end by support arm 51 and at an inboard end by boss 45 which is an integral part of mainrotor casing 40. Gaterotor shafts 55 have rotational axes 53. The basic geometrical relationship of rotational axes 53 of gaterotors 50 with respect to the rotational axis 24 of mainrotor 20 is conventional. Gaterotor support arms 51 are affixedly attached to the mainrotor casing 40 by means such as welding. Gaterotors 50 are positioned on gaterotor shafts 55 in a manner that permits adjustment of the axial position of gaterotor 50 on gaterotor shaft 55 after gaterotors 50 and gaterotor shafts 55 are generally assembled. The position of a gaterotor may be adjusted by threading the point of engagement of gaterotor shaft 55 and mainrotor casing 40. Alternately, bearing means 54 may include a threaded collar which may be used to adjust the position of gaterotor 50 at the outward end of gaterotor shaft 55. The purpose of the adjustment is to optimize the clearances between gaterotor teeth 52 and mainrotor threads 21. This adjustment is made during the initial manufacture of the compressor and also is made during the life of the compressor to compensate for wear of mainrotor teeth 21 and gaterotor teeth 52. By later adjustment after wear has taken place, machine clearances approaching the original clearances are maintained. With the exception of the small portion of the gaterotors 50 that engages the threads 231 on mainrotor 20 within the mainrotor casing 40, equal areas of both sides of the gaterotors 50 and the gaterotor support arms 51 are exposed to the pressures of the inlet. Thus, the pressure on both sides of the gaterotors 50 is substantially the same. Therefore, there is no net resultant force acting to create a distortion of the relationship between the rotational axis 24 of the mainrotor 20 and the gaterotor axes 53 due to unbalanced pressure.

As the temperature of the mainrotor 20 and the mainrotor casing 40 increases, mainrotor 20 and mainrotor casing 40 grow due to the thermal expansion resulting from the work of compression, gaterotor shaft 55, being affixedly attached to boss 45 on the outer surface of casing 40, also incrementally shifts, thrusting gaterotors 50 along their respective axes tending to maintain constant clearances between gaterotor teeth 52 and mainrotor teeth 21.

Pressure vessel 60 is generally cylindrical in shape, provided toward a closed end with an inlet means identified as fluid inlet tubing 61, and open at a flanged end 65. Flanged end 65 of pressure vessel 60 has equispaced bores 66 along its periphery and an annular groove 62 in its top surface. Pressure vessel 60 need only have enough structural integrity to withstand suction pressure, and does not need any structural integrity for rotational support of the cooperating mainrotor 20 and gaterotors 50. Consequently, elastic distortion of pressure vessel 60 is permitted and pressure vessel 60 can accordingly be of relatively light gauge material. Pressure vessel 60 is removably secured to the support plate 10 by fastening means such as a plurality of cap screws 63. Sealing means 64, such as for example an O-ring is fitted into the pressure vessel annular groove 62 and provides pressure tight sealing between pressure vessel 60 and support plate 10.

Pressure vessel 60 may be readily removed from support plate 10 for the purpose of alignment, inspection and maintenance of mainrotor 20 and gaterotors 50. For example, as the teeth 52 wear on gaterotor 50, the axial position of the gaterotor may be easily adjusted by means such as for example, threaded adjustment, to re-establish the design clearances between the mainrotor 20 and the gaterotor 50.

Figure 3:
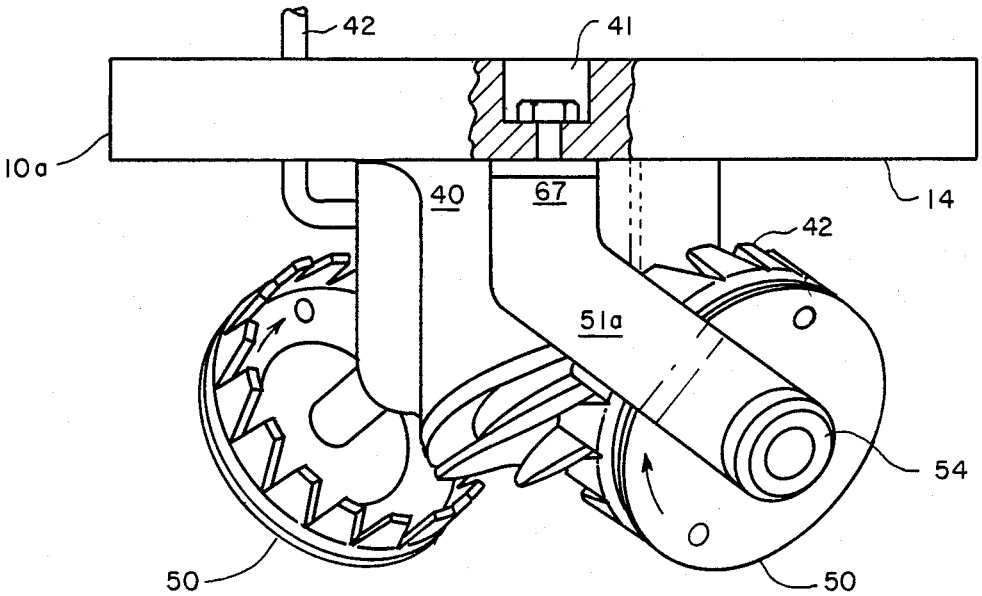
FIG. 3, illustrates a partially cut away plan view of a second embodiment of a single screw compressor wherein the support structure for the gaterotors is a modified version of the embodiment shown in FIG. 1.
Figure 4:
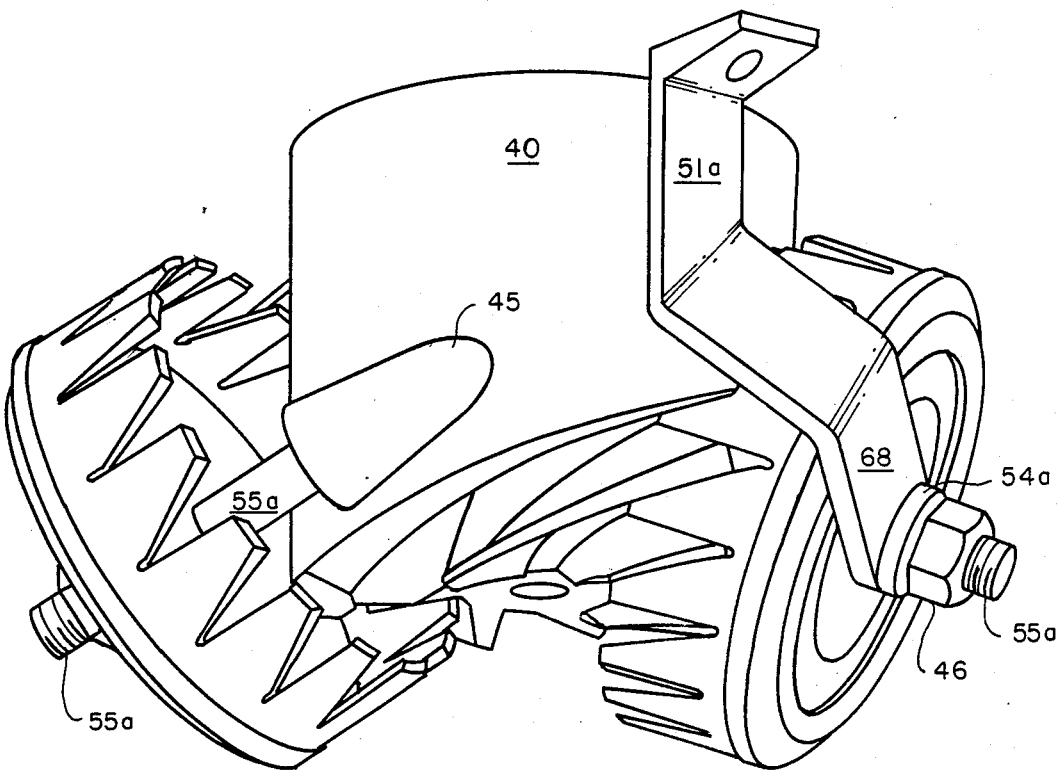
FIG. 4 is a perspective view of a portion of the compressor illustrated in FIG. 3.

FIGS. 3 and 4 show a second embodiment of a single screw compressor support structure of the present invention. Mainrotor casing 40 and support plate **10*a* form a central structure within the compressor. A plurality of support arms 51*a* are each removably attached at an upper end 67 to the bottom surface 14 of support plate 10*a* by fastening means such as, for example, cap screws 41 and are provided at a lower end 68 with a bore for receiving a gaterotor shaft bearing 54. One support arm 51*a* is used for mounting each gaterotor 50. One support arm 51*a* is illustrated in FIG. 2. Although a second arm is not illustrated, the location of such second arm can best be described as being symmetrically opposite the arm shown. In a similar manner as in the first embodiment, the position of a gaterotor may be adjusted by threading the point of engagement of gaterotor shaft 55 and mainrotor casing 40. Alternately, bearing means 54 may include a threaded collar which may be used to adjust the position of gaterotor 50 at the outward end of gaterotor shaft 55. This arrangement permits more rapid installation and removal of a gaterotor 50 than does the first embodiment. Temperature compensation occurs in a similar manner as in the first embodiment. In the second embodiment, the mounting plate 10 is subjected to a similar temperature rise as the mainrotor casing 40. As the temperature rises, the thermal expansion of support plate 10*a* causes the outward position of arms 51*a* and consequently gaterotor axes 53 to follow the thermal expansion, relieving the closure of the clearances between mainrotor 20 and gaterotors 50 that results form the thermal expansion of mainrotor 20 and mainrotor casing 40**. In other respects the operation of the second embodiment is equivalent with the operation of the first embodiment.

Obviously, numerous modifications and variations of the present invention are possible in the light of the above teachings. It is therefore to be understood that within the scope of the appended claims the invention may be practiced otherwise than as specifically described herein.

What is claimed is:

1. A single screw compressor for varying the pressure of a gas, comprising:

a mainrotor formed with a plurality of threads:

a central structure having a central bore, said central bore cooperating with said mainrotor forming at least one compression chamber;

a gaterotor shaft having an inward end and an outward end, said inward fend attached to said central structure;

a gaterotor having teeth in meshing relation with said mainrotor threads, said gaterotor rotationally mounted on said gaterotor shaft; and, an elongate support arm attached at an inward end to said central structure and at an outward end to said gaterotor shaft.

2. A single screw compressor for varying the pressure of a gas as claimed in claim 1 wherein said central structure further comprises a casing and a support plate, said central bore disposed in said casing, said support plate attached to said casing and the points of attachment of said inward end of said gaterotor shaft and said inward end of said elongate arm are on said casing.

3. A single screw compressor for varying the pressure of a gas as claimed in claim 1 wherein said central structure further comprises a casing and a support plate, said central bore disposed in said casing, said support plate attached to said casing and the point of attachment of said inward end of said gaterotor shaft is on said casing and the point of attachment of said inward end of said elongate arm is on said support plate.

4. A single screw compressor for varying the pressure of a gas, as claimed in claim 2 further comprising a cover, said cover attached to said support plate, said cover enclosing said casing, said mainrotor, said gaterotor, said gaterotor shaft and said elongate arm in a non contacting relationship, said cover further comprising fluid inlet means.

5. A single screw compressor for varying the pressure of a gas, as claimed in claim 4 wherein said cover is a pressure vessel having a substantially uniform wall thickness, said pressure vessel sealedly attached to said support plate in a manner that permits the inlet of said mainrotor casing to operate at an elevated pressure.

6. A single screw compressor for varying the pressure of a gas, as claim 4 wherein said cover is removably attached to said support plate.

7. A single screw compressor as claimed in claim 5 wherein said compressor remains fully functional in the presence of substantial structural distortion of said pressure vessel.

8. A single screw compressor as claimed in claim 5 said wall thickness of said pressure vessel is substantially less than the thickness of said support plate.

9. A single screw compressor for varying the pressure of a gas as claimed in claim 7 wherein said substantial structural distortion results in permanent deformation.

10. A single screw compressor for varying the pressure of a gas, as claimed in claim 3 further comprising a cover, said cover attached to said support plate, said cover enclosing said casing, said mainrotor, said gaterotor, said gaterotor shaft and said elongate arm in a non contacting relationship, said cover further comprising fluid inlet means, 11. A single screw compressor for varying the pressure of a gas, as claimed in claim 10 wherein said cover is a pressure vessel having a substantially uniform wall thickness, said pressure vessel sealedly attached to said support plate in a manner that permits the inlet of said mainrotor casing to operate at an elevated pressure.

12. A single screw compressor for varying the pressure of a gas, as claim 10 wherein said cover is removably attached to said support plate.

13. A single screw compressor as claimed in claim 11 wherein said compressor remains fully functional in the presence of substantial structural distortion of said pressure vessel.

14. A single screw compressor as claimed in claim 11 said wall thickens of said pressure vessel is substantially less than the thickness of said support plate.

15. A single screw compressor for varying the pressure of a gas as claimed in claim 13 wherein said substantial structural distortion results in permanent deformation.

16. A single screw compressor as claimed in claim 1 further comprising means for adjusting the position of said gaterotor along the axis of said gaterotor shaft.

17. A single screw compressor for varying the pressure of a gas, comprising:

a mainrotor formed with a plurality of threads, said mainrotor having an integral mainrotor shaft extending axially from said mainrotor;

a casing, open at one end and having a large diameter bore for accommodation of said mainrotor and a small diameter bore for accommodation of said integral mainrotor shaft, said small diameter bore coaxial with said large diameter bore, said casing having a fluid outlet means and a fluid inlet means;

a support plate having a central bore with bearing means for rotationally supporting said mainrotor shaft, said support plate affixedly attached to said casing for coaxial alignment of said small diameter bore and said large diameter bore of said casing and said central bore of said support plate, said support plate having fluid outlet means in fluid communication with said fluid outlet means of said mainrotor casing;

at least one gaterotor having teeth in meshing relation with said mainrotor threads;

at least one gaterotor shaft having an inward end attached to said mainrotor casing, an intermediate length adapted for rotationally supporting said gaterotor and an outward end; and, at least one elongated support arm affixedly attached at an inward end to said casing and provided at an outward end with a bearing means for supporting said outward end of said gaterotor shaft.

18. A single screw compressor for varying the pressure of a gas as claimed in claim 17, wherein said compressor further comprises a cover, said cover further comprising a fluid inlet means, said cover affixedly attached to said support plate for encasing said mainrotor, said gaterotor, said elongate arm, said gaterotor shaft, and said mainrotor casing in a non-contacting relationship with said cover, said fluid inlet means of said cover in fluid communication with said fluid inlet means of said casing.

19. A single screw compressor for varying the pressure of a gas as claimed in claim 18, wherein said cover is a pressure vessel having a substantially uniform wall thickness, said pressure vessel sealedly attached to said support plate, whereby the inlet of said mainrotor casing is operable at an elevated pressure.

20. A single screw compressor for varying the pressure of a gas as claimed in claim 17 wherein said outward end of said elongate support arm further comprises a means for axially adjusting the operating position of said gaterotor on said gaterotor shaft for establishing the meshing relation of said mainrotor and said gaterotor teeth.

21. A single screw compressor for varying the pressure of a gas as claimed in claim 18 wherein said cover is removably attached to said support plate, whereby said cover may be removed for the purpose of inspection and alignment of said meshing relationship between said mainrotor and said gaterotor.

22. A single screw compressor as claimed in claim 19 wherein said compressor remains fully functional in the presence of substantial structural distortion of said pressure vessel when said inlet of said casing is operated at elevated pressures.

23. A single screw compressor as claimed in claim 19 wherein said wall thickness of said pressure vessel in substantially less than the thickness of said support plate.

24. A single screw compressor as claimed in claim 22 wherein said substantial structural distortion results in permanent deformation.

25. A single screw compressor for varying the pressure of a gas, comprising:

a mainrotor formed with a plurality of threads, said mainrotor having an integral mainrotor shaft extending axially from said mainrotor;

a casing, open at one end and having a large diameter bore for accommodation of said mainrotor and a small diameter bore for accommodation of said integral mainrotor shaft, said small diameter bore coaxial with said large diameter bore, said casing having a fluid outlet means and a fluid inlet means;

a support plate having a central bore with bearing means for rotationally supporting said mainrotor shaft, said support plate affixedly attached to said casing for coaxial alignment of said small diameter bore and said large diameter bore of said casing and said central bore of said support plate, said support plate having fluid outlet means in fluid communication with the fluid outlet means of said mainrotor casing;

at least one gaterotor having teeth in meshing relation with said mainrotor threads;

at least on gaterotor shaft having an inward end attached to said mainrotor casing, an intermediate length adapted for rotationally supporting said gaterotor and an outward end; and, at least one elongate support arm affixedly attached at an inward end to said support plate and provided at an outward end with a bearing means for supporting said outward end of said gaterotor shaft.

26. A single screw compressor for varying the pressure of a gas as claimed in claim 25, wherein said compressor further comprises a cover, said cover further comprising a fluid inlet means, said cover affixedly attached to said support plate for encasing said main rotor, said gaterotor, said elongate arm, said gaterotor shaft, and said mainrotor casing in a non-contacting relationship with said cover, said fluid inlet means of said cover in fluid communication with said fluid inlet means of said casing.

27. A single screw compressor for varying the pressure of a gas as claimed in claim 26, wherein said cover is a pressure vessel having a substantially uniform wall thickens,s said pressure vessel sealedly attached to said support plate, whereby the inlet of said mainrotor casing is operable at an elevated pressure.

28. A single screw compressor for varying the pressure of a gas as claimed in claim 25 wherein said outward end of said elongate support arm further comprises a means for axially adjusting the operating position of said gaterotor on said gaterotor shaft for establishing the meshing relation of said mainrotor and said gaterotor teeth.

29. A single screw compressor for varying the pressure of a gas as claimed in claims 26 and 27 wherein said said cover is removably attached to said support plate, whereby said cover may be removed for the purpose of inspection and alignment of said meshing relationship between said mainrotor and said gaterotor.

30. A single screw compressor as claimed in claim 27 wherein said compressor remains fully functional in the presence of substantial structural distortion of said pressure vessel when said inlet of said casing is operated at elevated pressures.

31. A single screw compressor as claimed in claim 27 wherein the wall thickness of said pressure vessel in substantially less than the thickness of said support plate.

32. A single screw compressor as claimed in claim 30 wherein said substantial structural distortion results in permanent deformation.

* * * * *